US006694790B2

(12) United States Patent
Ryntz et al.

(10) Patent No.: US 6,694,790 B2
(45) Date of Patent: Feb. 24, 2004

(54) MID PLATE PROCESS AND EQUIPMENT FOR THE SUPERPLASTIC FORMING OF PARTS FROM PLURAL SHEETS

(75) Inventors: Edward Frank Ryntz, Warren, MI (US); Richard Murray Kleber, Clarkston, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/124,079

(22) Filed: Apr. 17, 2002

(65) Prior Publication Data

US 2003/0196466 A1 Oct. 23, 2003

(51) Int. Cl.[7] ..... B21D 39/20
(52) U.S. Cl. ..... 72/60
(58) Field of Search ..... 72/60, 61, 63; 29/421.1; 73/54, 56, 57

(56) References Cited

U.S. PATENT DOCUMENTS 3,920,175 A * 11/1975 Hamilton et al. ..... 228/173.2
5,819,572 A 10/1998 Krajewski ..... 72/42
5,974,847 A 11/1999 Saunders et al. ..... 72/57
6,047,583 A 4/2000 Schroth ..... 72/60
6,341,515 B2 * 1/2002 Huber et al. ..... 72/60
6,354,124 B1 * 3/2002 Burgel et al. ..... 72/60
6,418,607 B1 * 7/2002 Seifert et al. ..... 29/421.1

OTHER PUBLICATIONS

U S SN 09/950,229 file Sep. 10, 2001 entitled "Plural Sheet Superplastic Forming Equipment and Process" Richard Kleber, (Attorney Docket GP–300626).

* cited by examiner

*Primary Examiner*—Allen Ostrager
*Assistant Examiner*—John S. Goetz
(74) *Attorney, Agent, or Firm*—Kathryn A. Marra

(57) ABSTRACT

Superplastic forming of sheet metal blanks is advanced both is quantity and quality with the utilization of a part separating and pressure distributing mid plate sandwiched between a pair of blanks. This arrangement is loaded between upper and lower die halves operatively mounted in a heated press which closes to effect the piercing of one of the blanks by a nozzle which subsequently delivers pressurized air or other inert gas to an intermediate chamber formed by the mid plate between the blanks to effect the simlayaneously forming of separate parts in both forming dies.

6 Claims, 4 Drawing Sheets

FIG-3
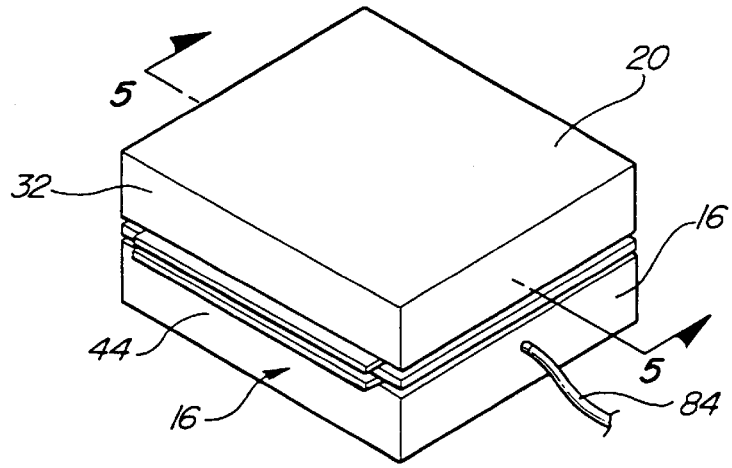
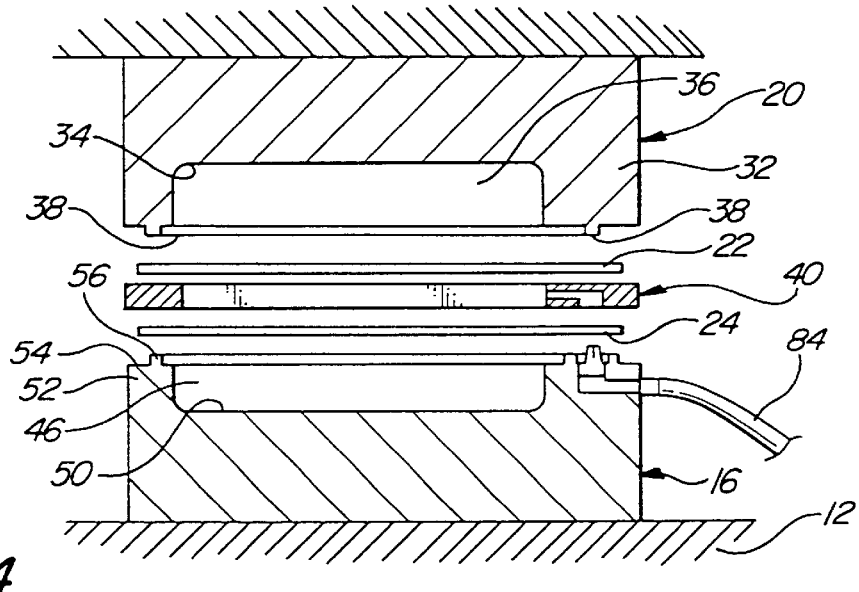
FIG-4
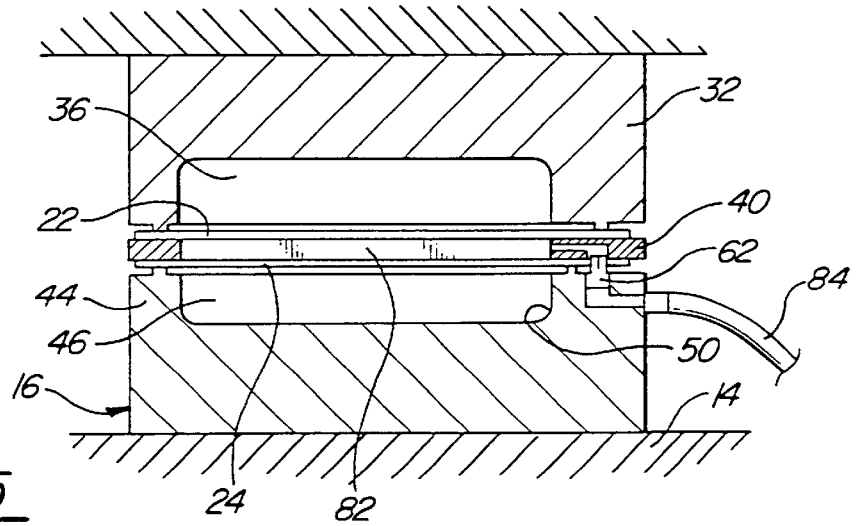
FIG-5

FIG-6
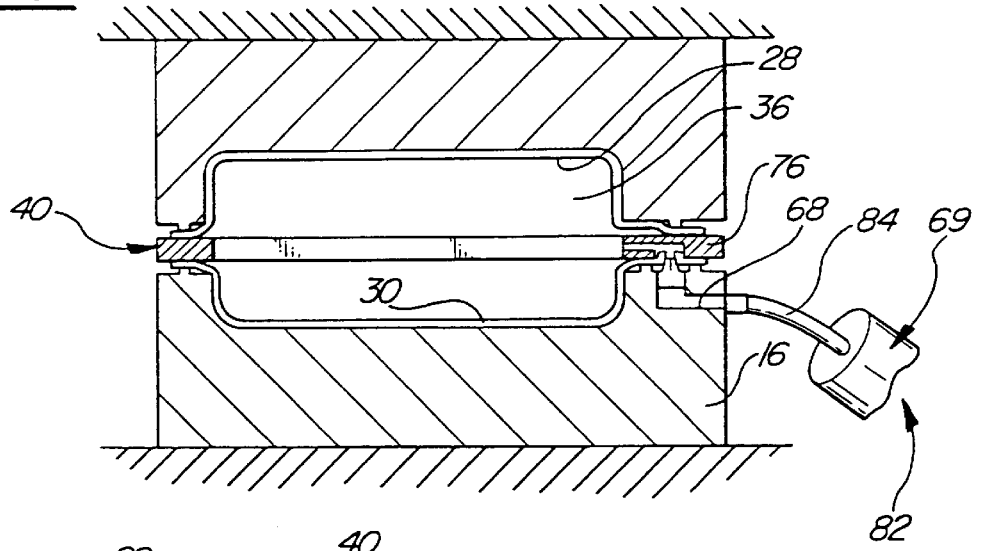
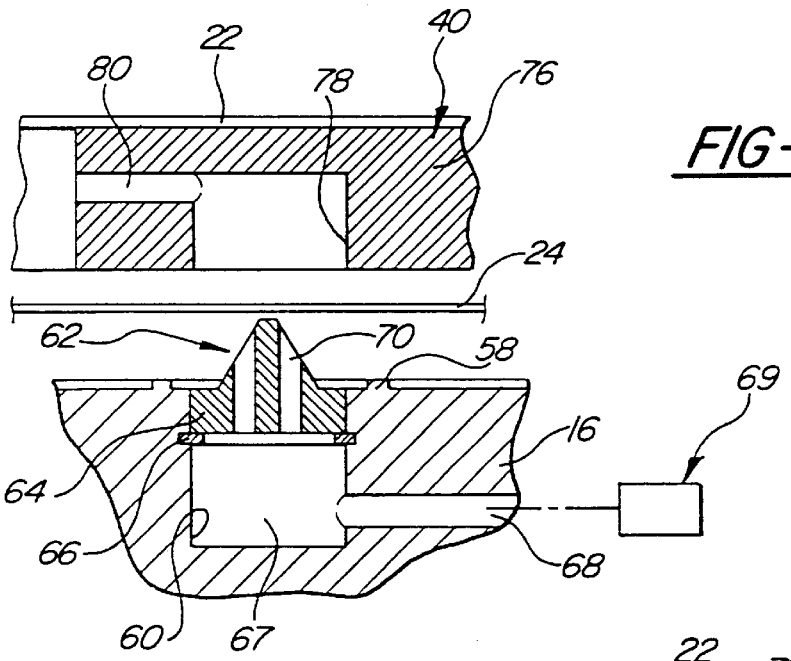
FIG-7A
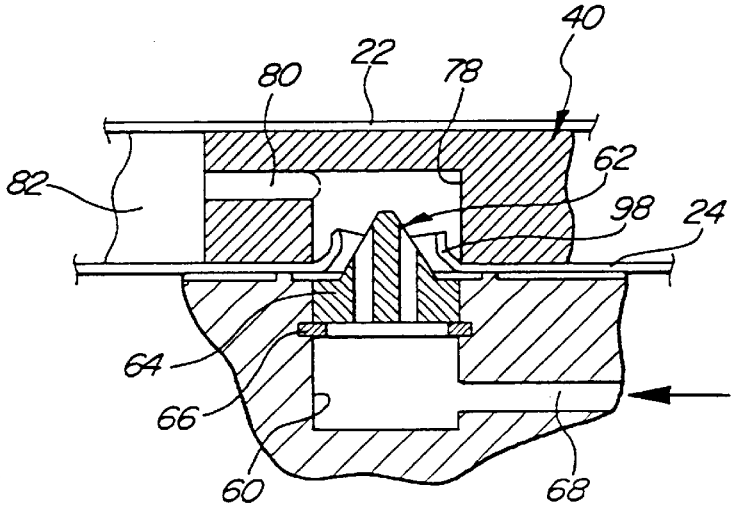
FIG-7B

MID PLATE PROCESS AND EQUIPMENT FOR THE SUPERPLASTIC FORMING OF PARTS FROM PLURAL SHEETS

TECHNICAL FIELD

This invention relates to new and improved superplastic forming process and equipment for the simultaneous production of multiple parts using sheet metal blanks and forming dies and more particularly to such equipment and process with the employment of an intermediate part separating and pressure distributing plate.

BACKGROUND OF THE INVENTION

Prior to the present invention, various types of superplastic forming equipment and processes have been developed for shaping blanks of metallic sheet material into a wide range of items. The forming dies of such equipment and processes are generally mounted in presses that are capable of maintaining elevated temperatures in the dies and metal sheet material necessary for superplastic forming. More specifically, such temperature elevation enhances the capacity of the metal to tolerate strain-induced deformation without tearing and importantly diminishes the force required for deformation. A time controlled compressed air charge is typically delivered to the forming equipment to apply the force on the heated metal blank to superplastically form the metal on the forming die.

In more specific detail relative to the present invention, superplastic forming involves the employment of a ductile sheet of superplastic metal alloy positioned between dies in a press whose temperature is increased by the heat energy maintained in the press. The heated sheet is stretched by the force of the compressed air into forming cavities or onto forming surfaces of heated forming dies to produce high-quality, lightweight parts such as panels for automotive vehicles. Often such sheets are quite large and components such as trunk lids, engine hoods and these or other large panels can be precisely formed in one piece by such superplastic forming.

Examples of such processes and equipment are found in U.S. Pat. No. 5,974,847 issued Nov. 2, 1999 to Sanders et al. for Superplastic Forming Process and U.S. Pat. No. 5,819,572 issued Oct. 13, 1998 to P. E Krajewski for Lubricating System For Hot Forming, both assigned to the assignee of this invention and both hereby incorporated by reference.

In the patent to Sanders et al. a blank sheet of metal alloy is heated to a superplastic forming temperature and is pulled over and around a forming insert in a die set. Subsequently using differential gas pressure, the sheet is further stretched into conformity with the forming surface of the die insert or other die configuration so that thinning of the formed part is minimized. In the patent to Krajewski, dry lubricant is applied to a metallic sheet which is subsequently heated to predetermined forming temperatures and formed into a part in superplastic forming die equipment. The lubricant initially provides improved forming of the part and subsequently improved release of the formed part from the forming die.

While the above identified patent disclosures provide improvements in super plastic forming they often do not attain new and higher standards for enhanced rates of production of superplastically formed parts.

To improve the rate of production of superplastically formed parts new equipment and processes have been proposed or planned. Copending U.S. patent application Ser. No. 09/950,229 (GP 300636) entitled Plural Sheet Superplastic Forming Euipment and Process by Richard Kleber filed on Sep. 10, 2001, assigned to the assignee of this invention and hereby incorporated by reference is exemplary. In that application a pair of forming blanks are loaded between heated forming dies and a pressurization wedge is forced from one side edge to a position between the sheets to effect pressure sealing therebetween. Pressurized inert gas is fed through passages in the pressurization wedge to the interface of the heated sheets to effect the simultaneous superplastic forming of parts from the two sheets by displacing them onto the profiles of the opposing dies.

SUMMARY OF THE INVENTION

In contrast to the prior art, the present invention increases superplastic forming production rates by providing new and improved constructions and methods for the simultaneous formation of at least two sheets of superplastic sheet metal into two separate parts from the same deformation force. Moreover and in further contrast to the disclosure in the above referenced copending patent application, the present invention provides for the employment of a frame-like, pressure-distributing mid plate sandwiched between upper and lower sheets or blanks of superplastically deformable metals. This sandwiched and flattened arrangement of blanks and mid plate is placed between upper and lower die halves mounted in a press that raises the heat energy level of the blanks to a range sufficient to optimize their subsequent plastic deformations.

The dies are subsequently closed to effect peripheral gas tight sealing between the mid plate and the upper and lower sheets. A gas delivery and sheet piercing nozzle carried by one of the dies penetrates one of the blank sheets and operatively seats into a vertical bore or socket formed in one of the sides of the mid plate. This socket communicates with a horizontally-extending, gas-distributing passage provided in at least one side of the mid plate that leads to a centralized gas chamber or space defined by the surrounding sides of the mid plate and the blank sheet arrangement mounted on opposite sides of the mid plate. The forces applied by the expanding pressurized gas such as air, delivered via the nozzle and gas distribution passages into the gas chamber simultaneously effects the displacement of the sheets in opposite directions onto the opposing forming surfaces of the two forming dies. This results in the simultaneous superplastic forming of separate and independent parts or the forming of two mating parts with matching interfaces.

The equipment of this invention provides improved superplastic forming and improved production rates of super plastically formed parts. This invention importantly meets higher standards for quantity production of high quality parts superplastically formed from metallic sheets operatively mounted in hot forming dies particularly using a press and operating at elevated temperatures.

It is a feature, object and advantage of this invention to provide new and improved equipment and methods to produce superplastically formed parts in which a common pressure is introduced to an inner chamber formed between blank sheets peripherally sealed with respect to one another and with upper and lower part forming dies. A pressurized gas is introduced via a gas delivery and sheet piercing nozzle carried by one of the dies and a connecting passage way to the inner chamber provided by a mid plate supporting and separating the blank sheets between the forming dies. The force of this gas displaces the sheets away from one another onto profiling structure of the dies to simultaneously form discrete parts reflective of the upper and lower profiled forming surfaces.

Another feature object and advantage of the present invention is to provide a new and improved die with a gas delivery and sheet piercing nozzle and a cooperating part separating and gas pressure distributing mid plate for superplastic forming. This augments forming of multiple and separate parts from pairs of metallic blank sheets seated on opposite sides of the mid plate and sealed between upper and lower forming dies.

In a preferred form of the invention a frame-like mid plate having flattened upper and lower contact sides with peripheral fluid seals is sandwiched between upper and lower sheets of metal to be superplastically formed. This sandwiched arrangement is operatively placed between heated forming dies in a press that is subsequently closed and pressurized gas from a nozzle carried by a die which pierces a sheet is injected into a pressure chamber formed within the confines of the frame and the upper and lower sheets mounted thereon. The sheets heated by heat energy transferred from the dies, are displaced in opposite directions by injected gas pressure and superplastically form against the forming surfaces thereof.

With this process and equipment the blank sheets can all be of the same dimensions facilitating handling, forming, and consequently identical pairs of parts can be readily formed with reduced trimming and scrap. The sheets may be of differing dimensions and material depending on specifications.

BRIEF DESCRIPTION OF THE DRAWINGS

These and other objects, advantages and features of the invention will become more apparent from the following detailed description of one preferred embodiment of the invention and drawing in which:

FIG. 3 is a pictorial view illustrating the equipment of FIGS. 2A and 2B moved to a closed position for the superplastic forming of the sheet metal blanks;

FIG. 4 is a cross sectional view taken generally along sight lines 4—4 of FIG. 2B;

FIG. 5 is as cross sectional view taken generally along sight lines 5—5 of FIG. 3;

FIG. 6 is a cross sectional view similar to the view of FIG. 5 illustrating the superplastic forming of the blanks into a plurality of components; and FIGS. 7A and 7B are enlarged cross sectional views of portions of FIGS. 5 and 6, respectively, illustrating before and after piercing of one of the sheet metal blanks by a piercing nozzle carried by the lower die of the forming equipment of this invention.

BRIEF DESCRIPTION OF THE PREFERRED EMBODIMENT

Figure 1:
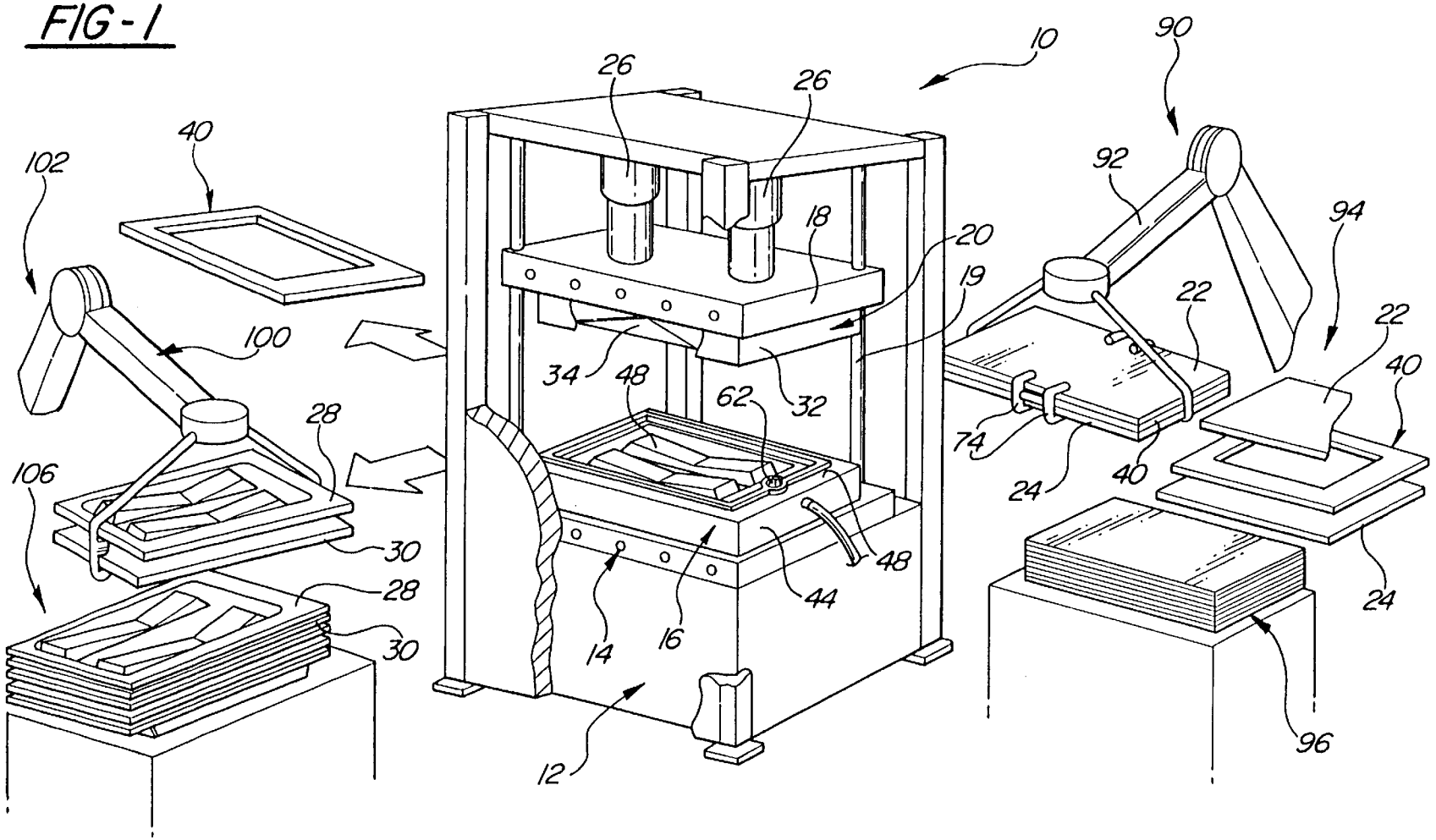
FIG. 1 is a pictorial view of superplastic forming equipment according to this invention for simultaneously forming pairs of sheet metal blanks into plurality of formed parts.

Turning now in greater detail to the drawing, FIG. 1 illustrates a forming press 10 comprising a base member 12 supporting a lower bolster plate 14 on which lower tool or forming die 16 is mounted. The press additionally has an upper carrier plate 18 operatively mounted for reciprocating movement on upstanding rails 19 extending from the base. The carrier plate 18 securely mounts the upper tool or forming die 20, which projects downwardly therefrom. Both plates 14 and 18 are electrically heated to establish the required heat energy levels in the upper and lower dies and the upper and lower sheet metal blanks 22, 24 loaded therein for super plastic forming.

The upper carrier plate 18 of the press is cycled by hydraulic cylinders 26 from the illustrated open position shown in FIG. 1 for loading of the two sheet metal blanks 22, 24 to the closed position shown in FIG. 3 for the superplastic forming of the blanks into two discrete parts and then back to the open position for removal of the formed parts from the hot forming dies. A second pair of blanks can then be loaded into the forming dies for another cycle to form additional parts.

The upper and lower blanks 22, 24 utilized with this invention may be flattened rectilinear sheets of aluminum alloy coated with a dry lubricant such boron nitride to function as an agent to enhance the stretching and forming of the parts 28, 30 during super plastic forming operation and to prevent the formed parts 28, 30 from adhering to the associated forming dies. These blanks and formed parts may be identical to one another or may be of differing designs, dimensions and materials depending on part specifications.

As best shown in FIG. 1 the upper tool or forming die 20 is operatively connected to the upper carrier plate and projects downwardly therefrom. This tool has a downwardly extending and generally rectilinear peripheral wall 32 that may encompass a forming insert 34 therein. The interior of the upper forming die may also be smooth and continuous or have other interior forming surfaces to define a profiling cavity 36 (see FIGS. 4 and 5). In any event, the peripheral wall 32 terminates in a flattened face that has a rectilinear seal forming bead 38 projecting downwardly therefrom that is operative to engage the upper surface of blank 22 under load. This bead establishes full perimeter retention and sealing between the upper blank 22 and a part separating and pressure distributing mid plate 40 used in the superplastic forming of this invention.

The lower tool or forming die 16 extends upwardly from support by the bolster plate 14 and has a rectilinear peripheral wall 44 the interior of which defines a forming cavity 46. As with the upper tool, the lower tool 16 may have a forming insert such as insert 48 shown in FIGS. 1, 2*a* and 2*b* operatively mounted therein or have interior wall surfaces 50 shown in FIGS. 4 and 5 that may be smooth or formed with profiling surfaces for part profiling purposes. In any case the peripheral wall of the lower tool has a flattened upper surfaces 54 that faces the flattened surface of the upper tool and is further provided with an upwardly projecting and generally rectilinear peripheral sealing bead 56 designed to operatively engage the lower sheet metal blank 24 loaded between the forming dies to effect perimeter fluid sealing between the lower blank and the mid plate 40.

Figure 2B:
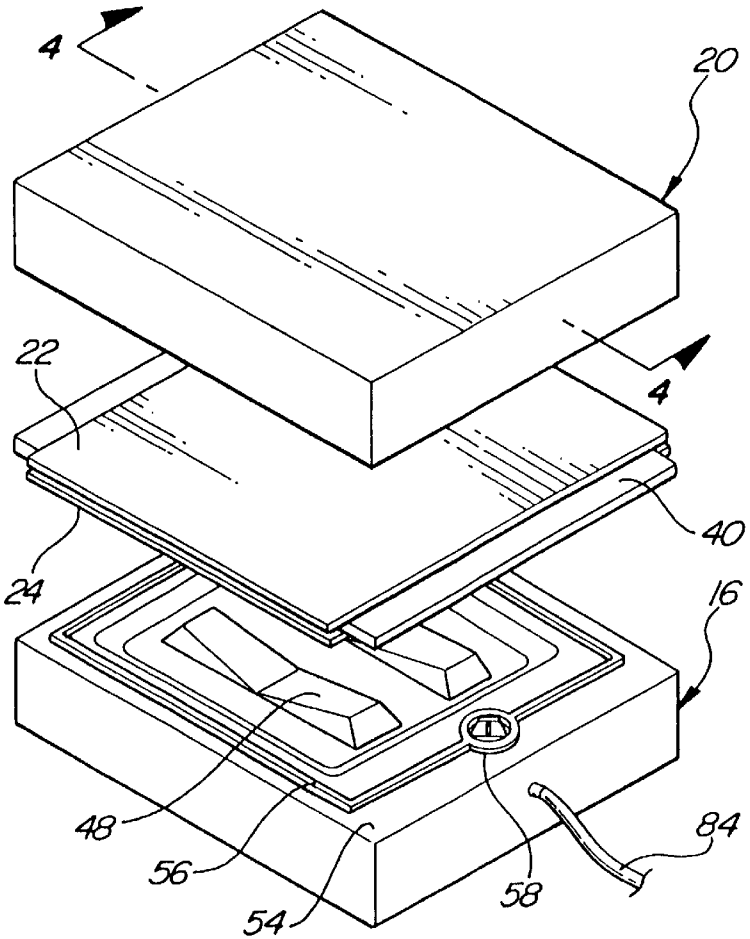
FIG. 2B is a pictorial view of the equipment of FIG. 2A but with a pair of sheet metal blanks sandwiching the mid plate.
Figure 2A:
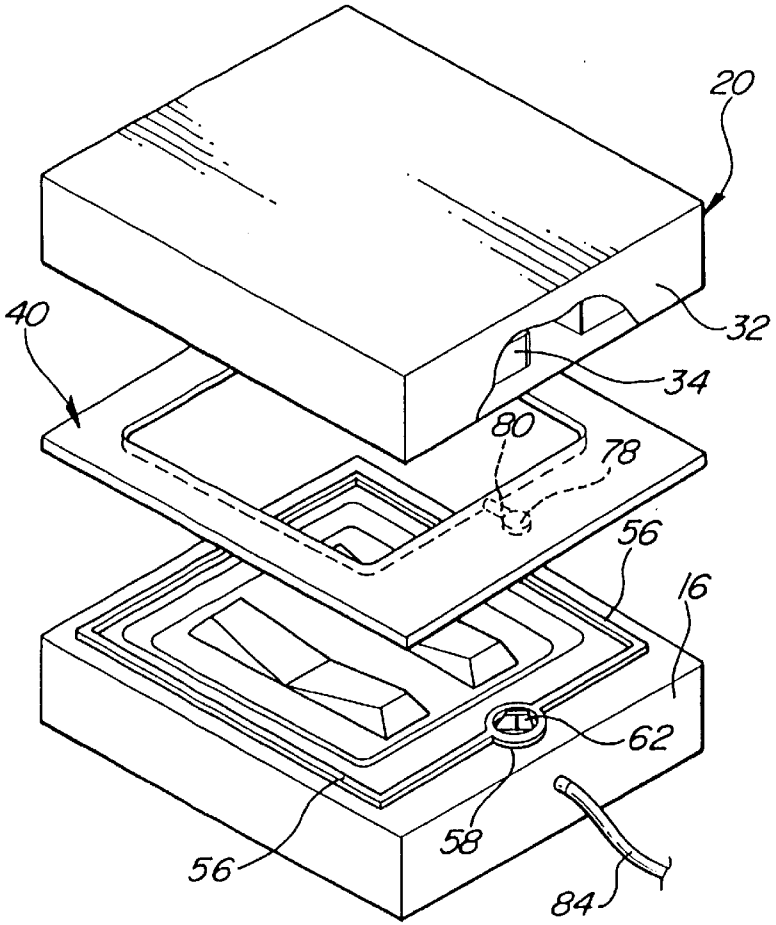
FIG. 2A is a pictorial view of spaced upper and lower forming dies with a mid plate diagrammatically shown therebetween.

FIGS. 2*a* and 2*b* show details of the configuration of the sealing bead 56 of the lower tool in which the rectilinear bead is provided with an encircling section 58 located mid-way along one side thereof that surrounds and peripherally seals a cylindrical bore 60 extending vertically through the upper surface of the lower tool 16. This bore defines a cylindrical recess that accommodates a sheet-piercing nozzle 62 of steel or other suitable material operatively mounted therein. More particularly the nozzle 62 has a cylindrical body portion 64 closely fitted into bore 60 and seated on an expanding spring washer 66 internally mounted in the bore. The nozzle cooperates with the bore and establishes an internal chamber 67 that communicates with a gas conducting passage 68 extending through the side of the lower tool and that operatively connects to a source 69 of pressurized gas such as air as illustrated in FIGS. 6, 7*a* and 7*b*. The upper section of the nozzle is conical or otherwise configured and extends above the plane on the upper face of the lower tool so that it can pierce the lower blank 24 for superplastic forming operation. Gas passages 70 extending through the nozzle are operative to conduct pressurized gas from the source via passage 68 and chamber 67 for superplastic forming. These passageways also serve to exhaust the forming gasses after forming is completed.

The part separating and gas distributing mid plate 40 may be in the form of a flat, rectilinear frame provided for operation with the upper and lower forming dies for the superplastic forming of plural parts. The upper and lower surfaces of the sides of the mid plate are flat and fit against the outer surfaces of upper and lower blanks in a sandwiched arrangement as diagrammatically illustrated in FIGS. 3, 4 and 5. Suitable clips or clamps 74 may be employed to hold the flat blank sheets and mid-plate in a sandwiched or packaged arrangement to facilitate handling. The side 76 of the mid-plate that corresponds to the side of the lower tool 16 mounting the nozzle 62 is formed with a cylindrical bore 78. This bore opens to the undersurface of the mid-plate and aligns with the vertical bore 60 in the lower tool and the nozzle 62 operatively mounted therein. The mid plate bore 78 is sized to accommodate the conical section of the nozzle 62 when the press is closed and the upper and lower dies are in part forming position relative to the mid plate. Bore 78 further communicates with one or more laterally extending passages 80 that lead inwardly into a centralized chamber 82 defined by the encompassing inner peripheral walls of the rectilinear mid plate 72 and the upper and lower blanks 22 and 24 operatively mounted thereon.

Pressurized air or other inert gas for super plastic forming of the blanks 22, 24 is supplied into the equipment from the source 69 such as a pressure regulated pump that has an output operatively connected to a flexible hose 84 that in turn connects to passage 68 in the lower tool.

In operation, a robot 90 may move into a loading position and lower an operating arm 92 thereof to grasp and pick work 94 here a pair of flattened sheets comprising upper and lower sheet metal blanks 22, 24 from a stack 96 of blanks. A mid plate 40 is loaded therebetween in a sandwiched arrangement. These assembled components can be packaged or otherwise held together by clamps or clips 74 which are releasably mounted thereon. This assembly can then be placed by robot operation between the heated upper and lower dies in the opened press. After releasing the packaged blanks and mid plate, the robot 90 moves to an out-of-way position and the press is closed so that the tools are positioned as illustrated in FIG. 5. In this position there is effective fluid perimeter sealing between the mid-plate and the heated upper and lower blanks because of the load imparted by the sealing beads on the upper and lower blanks. Additionally nozzle 62 pierces the lower sheet or blank 24 as best shown at 98 in FIG. 7*a* thereby opening the pressure chamber established between the blank plates as shown in FIG. 7*a*.

Appropriate forming pressure is then fed via the nozzle into the pressure chamber 82 of the mid-plate and the heated blanks seated and pressure sealed on the mid plate. The separate sheet metal blanks having reached a superplastic forming temperature, are displaced in opposite directions by the force exerted thereon by the pressurized air. Resultantly these blanks are superplastically formed against the forming surfaces of the dies. After such forming, the press is opened so that the formed parts are exposed. An arm 100 of a second robot 102 or other suitable unloading tool is moved into the opened forming dies to pick up the hot formed parts 28, 38 and moves them into accumulating stack 106. The mid plate 40 is removed after the parts are formed and returned to the loading station for reuse in subsequent superplastic forming operation as described above.

While some preferred methods and mechanisms have been disclosed to illustrate this invention, other methods and mechanisms embracing this invention will now be apparent to those skilled in the art. Accordingly, the scope of the invention is to be considered limited only by the following claims.

What is claimed is:

1. Superplastic forming die equipment for the simultaneous superplastic forming of pairs of metallic blanks into a plurality of shaped parts, said die equipment comprising a lower forming die, an upper forming die, said dies being relatively movable between opened and closed positions with respect to one another, each of said dies having part forming surfaces, one of said dies having a gas distribution nozzle associated therewith for delivering pressurized part forming gas for said equipment, a mid plate for operative disposition between upper and lower blanks to form a sandwiched and portable assembly of a pair of blanks so that said assembly can be physically transferred from a storage station and operatively mounted between said dies for the superplastic forming of said pair of blanks, said mid plate having a perimeter wall of predetermined thickness with upper and lower faces that support upper and lower blanks of said pair of blanks sandwiching the mid plate therebetween, said blanks and mid plate cooperating to define a forming gas chamber therebetween when said dies are in said closed position, said mid plate having a bore therein for reception of said nozzle when said dies are in said closed position, said mid plate further having a gas passage that extends from said bore through said perimeter wall into said forming gas chamber, said forming dies being adapted to respectively engage said upper and lower blanks to effect the perimeter sealing of said gas chamber and to permit said gas distribution nozzle to operatively enter said bore when said dies are in a closed position, said nozzle pneumatically communicating with said bore and said passage so that a pressurized gas supplied thereto effects the charging of said chamber with pressurized gas and the simultaneous displacement of the upper and lower blanks onto the forming surfaces of said forming dies.

2. Superplastic forming die equipment for the superplastic forming of pairs of sheet metal blanks into separate parts of predetermined shapes, said die equipment comprising, upper and lower forming dies relatively movable between opened and closed position so that pairs of sheet metal blanks can respectively be operatively loaded between said dies and then plastically formed in said dies, said superplastic forming die equipment being adapted to effect the heating of selected pairs said blanks to a superplastic forming temperature, one of said forming dies having a gas supplying nozzle carried therewith, a blank supporting and gas sealing mid plate adapted to be operatively mounted between a selected pair of said blanks to form a sandwiched and portable mid plate and blank assembly movable from a storage position spaced from said forming die equipment to a superplastic forming position between said dies, said mid plate having an interior perimeter wall to define an inner space therewith and to cooperate with said pair of blanks to thereby establish a gas receiving chamber, a bore in said mid plate for receiving said gas supplying nozzle, a gas passage in said mid plate extending from said bore into said chamber for transmitting a pressurized gas from said nozzle and said mid plate bore to said chamber to effect the superplastic displacement of said pair of sheet metal blanks in opposite directions and onto said dies disposed on opposite sides of said mid plate.

3. The construction of claim 2 and wherein said sheet metal blanks sandwiched by said mid plate are directly supported on upper and lower surfaces of said mid plate and wherein one of said forming dies has a nozzle chamber formed therein for operatively mounting said nozzle therein, said nozzle having a formed end for piercing one of said sheet metal blanks when said dies are in said closed position and for transmitting forming gas into said bore in said mid plate then to said gas passage and then into said forming chamber for the superplastic forming of separate parts.

4. The construction of claim 3 wherein said forming dies are formed with projecting sealing beads for peripheral contact with said blanks to form perimeter seals between said blanks and said mid plate, said bore of said mid plate receiving said nozzle being located internally of the perimeter seal formed between one of said blanks and said mid plate for the reception of pressurized gas to effect the superplastic forming of said blanks on the forming surfaces of said dies.

5. A method of simultaneously superplastically forming pairs of sheets of metallic superplastic forming material into separate parts utilizing upper and lower forming dies operatively movable between opened and closed positions and a mid plate having a gas passage therein to transmit gas from an input station to an internal gas chamber formed therewith comprising the steps of: mounting and retaining said sheets on opposite sides of said mid plate to form a discrete portable sheet forming unit, moving said forming dies to an opened position, transferring said sheet forming unit from a storage position spaced from said forming dies to an operative position between said forming dies, closing and heating said forming dies with said sheet forming unit therebetween so that the heat energy of said sheets attains a range sufficient for superplastic forming, piercing at least one of said sheets with a gas pressure delivery nozzle and positioning said nozzle in operative gas communication with said gas passage of said mid plate, charging said nozzle with a pressurized gas to thereby charge said internal gas chamber and effect the plastic displacement of said sheets onto the forming dies and the sheets into separate parts, moving said dies to an opened position, and removing the separate parts and the mid plate from the deforming dies.

6. The method of claim 5 and further comprising the steps of clamping said sheets to opposing side of said mid plate to form said sheet forming unit, closing said dies on said sheet forming unit to superplastically form said parts therein, opening said dies and removing said formed parts from said mid plate and said dies, reusing said mid plate to form another portable sheet forming unit of banks and mid plate and clamping said another sheet forming unit together to facilitate the handling thereof.

* * * * *